US005809807A

United States Patent [19]

Seo

[11] Patent Number: 5,809,807

[45] Date of Patent: Sep. 22, 1998

[54] WASHING MACHINE HAVING A MOVABLE SPIN TUB COVER ASSEMBLY

[75] Inventor: Jong-Seok Seo, Kwangju, Rep. of Korea

[73] Assignee: Daewoo Electronics Co., Ltd., Rep. of Korea

[21] Appl. No.: 775,080

[22] Filed: Dec. 30, 1996

[30] Foreign Application Priority Data

Dec. 30, 1995 [KR] Rep. of Korea ..... 95-68700

[51] Int. Cl.[6] ..... D06F 17/06; D06F 37/00

[52] U.S. Cl. ..... 68/23.6; 68/194

[58] Field of Search ..... 68/23.6, 23.7, 68/28, 29, 43, 53, 122, 133, 134, 186, 187, 194

[56] References Cited

U.S. PATENT DOCUMENTS

| | | | |
|---|---|---|---|
| 4,494,390 | 1/1985 | Hayashi et al. | 68/23.7 |
| 4,791,691 | 12/1988 | Fukuzawa et al. | 8/159 |
| 5,170,012 | 12/1992 | Braconier | 174/52.3 |

FOREIGN PATENT DOCUMENTS

| | | | |
|---|---|---|---|
| 519124 | 12/1955 | Canada | 68/194 |

*Primary Examiner*—Philip R. Coe

*Attorney, Agent, or Firm*—Cushman Darby & Cushman Intellectual Property Group of Pillsbury Madison & Sutro,LLP

[57] ABSTRACT

A washing machine which can immerse articles in a washing liquid has a spin tub formed at a side wall thereof with a pair of elongated slots, and a spin tub cover assembly for immersing the articles in the washing liquid. The elongated slots are longitudinally formed along the whole length of the spin tub. The spin tub cover assembly moves along the elongated slots. The spin tub cover assembly includes an annular frame, first and second coupling pins for movably coupling the annular frame to the spin tub, and a cover plate hinged to the annular frame. The cover plate has a latch which is detachably engaged with the annular frame. The washing machine can immerse the articles into the washing liquid by means of the spin tub cover assembly, so the articles widely collide with the liquid flows within the spin tub, thereby improving the washing effect.

14 Claims, 3 Drawing Sheets

WASHING MACHINE HAVING A MOVABLE SPIN TUB COVER ASSEMBLY

BACKGROUND OF THE INVENTION

1. Field of the Invention

The present invention relates to a washing machine, and more particularly to a washing machine having a movable spin tub cover assembly which permits clothing to be completely immersed in a washing liquid, thereby improving a washing effect.

2. Prior Arts

As is well known, a washing machine is an appliance for separating dirt from articles to be washed such as clothing by sequentially carrying out various cycles in the order of liquid feeding, washing, rinsing, dehydrating, and draining cycles.

While the above cycles are being executed, dirt contained in the articles separates from the articles by means of friction between a liquid flow and the articles or by means of detergents.

FIG. 3 shows such a conventional washing machine 500.

As shown in FIG. 3, conventional washing machine 500 includes a housing 510. An outer tub 520 for receiving a washing liquid is disposed in housing 510. Enclosed within outer tub 520 is a spin tub 530 formed at its side wall with a plurality of discharging holes 532. Below outer tub 520 but within housing 510, there are provided a motor 540 for generating a driving force, and a gear assembly 550 which transfers the driving force of motor 540 to spin tub 530 or to a pulsator 560 rotatably mounted on a bottom wall of spin tub 530.

While the washing cycle is being carried out, pulsator 560 is driven by motor 540, thereby creating a swirl-shaped liquid flow in spin tub 530. The swirl-shaped liquid flow collides with the articles in spin tub 530, so the articles are washed.

However, in conventional washing machine 500, the swirl-shaped liquid flows generated by pulsator 560 become weak as they reach an upper portion of spin tub 530 due to an interference by the articles. For this reason, when a large amount of articles are placed in spin tub 530, the washing effect at the upper portion of spin tub 530 is reduced. Particularly, articles having light weight are not completely immersed in the washing liquid, but float on the surface of the washing liquid in the direction of the liquid flows. As a result, the articles do not widely collide with the liquid flows, so the dirt contained in the articles is not completely separated from the articles.

In order to solve the above problem, various washing machines have been suggested, but they have presented many problems.

For example, U.S. Pat. No. 5,170,012 issued to Oh et al. discloses a washing machine having a pressure member which is controlled to be fixedly located at an optimum position inside a spin tub.

In Oh's washing machine, the pressure member, which is movably installed in the spin tub, repeats up and down movements while a washing cycle is being carried out, thereby not only immersing articles into a washing liquid, but also applying pressure to the articles. In this manner, Oh's washing machine improves the washing effect.

However, Oh's washing machine requires a separate driving apparatus including a plurality of gears and screws so as to operate the pressure member. Accordingly, Oh's washing machine has a complicated structure, and therefore, the assembling process of the washing machine is very difficult.

On the other hand, U.S. Pat. No. 4,791,691 issued to Fukuzawa et al. discloses a washing machine having a sprinkling port which can prevent articles from floating on the surface of a washing liquid. However, in order to prevent the articles from floating on the washing liquid, Fukuzawa's washing machine should supply a large amount of the washing liquid, about three to eight times larger in weight than the articles, into the spin tub. Accordingly, Fukuzawa's washing machine unnecessarily wastes the washing liquid. In addition, Fukuzawa's washing machine cannot completely immerse the articles into the washing liquid when a large amount of articles are placed in the spin tub.

Accordingly, it is required to provide a washing machine having a simple construction which can completely immerse articles into a washing liquid, thereby improving the washing effect.

SUMMARY OF THE INVENTION

The present invention has been made to overcome the above described problems of the prior arts, and accordingly, it is an object of the present invention to provide a washing machine having simple construction which can completely immerse articles into a washing liquid in such a manner that the articles can widely collide with a liquid flow, thereby improving the washing effect.

To achieve the above object, the present invention provides a washing machine comprising:

- a housing;
- an outer tub for receiving a washing liquid, the outer tub being disposed in the housing;
- a spin tub formed at a side wall thereof with a plurality of discharging holes, the spin tub being disposed in the outer tub;
- a pulsator rotatably mounted on a bottom wall of the spin tub; and
- a first means for immersing an article to be washed into the washing liquid.

According to a preferred embodiment of the present invention, the first means includes a spin tub cover assembly. The spin tub cover assembly has an annular frame movably disposed in the spin tub, a second means for movably coupling the annular frame to the spin tub, and a cover plate hinged to the annular frame.

The annular frame and the cover plate are manufactured with a material having a specific gravity lower than the specific gravity of the washing liquid, so the annular frame and the cover plate float on a surface of the washing liquid.

The second means includes first and second elongated slots longitudinally formed in the side wall of the spin tub in opposition to each other, first and second screw holes formed in an outer wall of the annular frame in opposition to each other, and first and second coupling pins which are respectively screw-coupled into the first and second screw holes through the first and second elongated slots.

When the washing liquid is supplied into the outer tub, the spin tub cover assembly moves upwards along the first and second elongated slots and floats on the surface of the washing liquid as the liquid level in the outer tub rises. Accordingly, the articles in the spin tub are completely immersed in the washing liquid without being exposed above the surface of the washing liquid.

Since the articles in the spin tub are completely immersed in the washing liquid, the articles can widely collide with the swirl-shaped liquid flows, so that the washing effect is improved.

While the washing liquid is being drained out of the washing machine, the spin tub cover assembly floating on the surface of the washing liquid moves downwards along the first and second elongated slots. When the washing liquid has been completely drained out of the washing machine, the spin tub cover assembly is seated on the articles.

Accordingly, the articles are prevented from flying out of the spin tub while a dehydrating cycle is being carried out.

BRIEF DESCRIPTION OF THE DRAWINGS

The above objects and other advantages of the present invention will become more apparent by describing in detail a preferred embodiment with reference to the attached drawings, in which.

DESCRIPTION OF THE PREFERRED EMBODIMENTS

Hereinafter, a preferred embodiment of the present invention will be described in detail with reference to the accompanying drawings.

Figure 1:
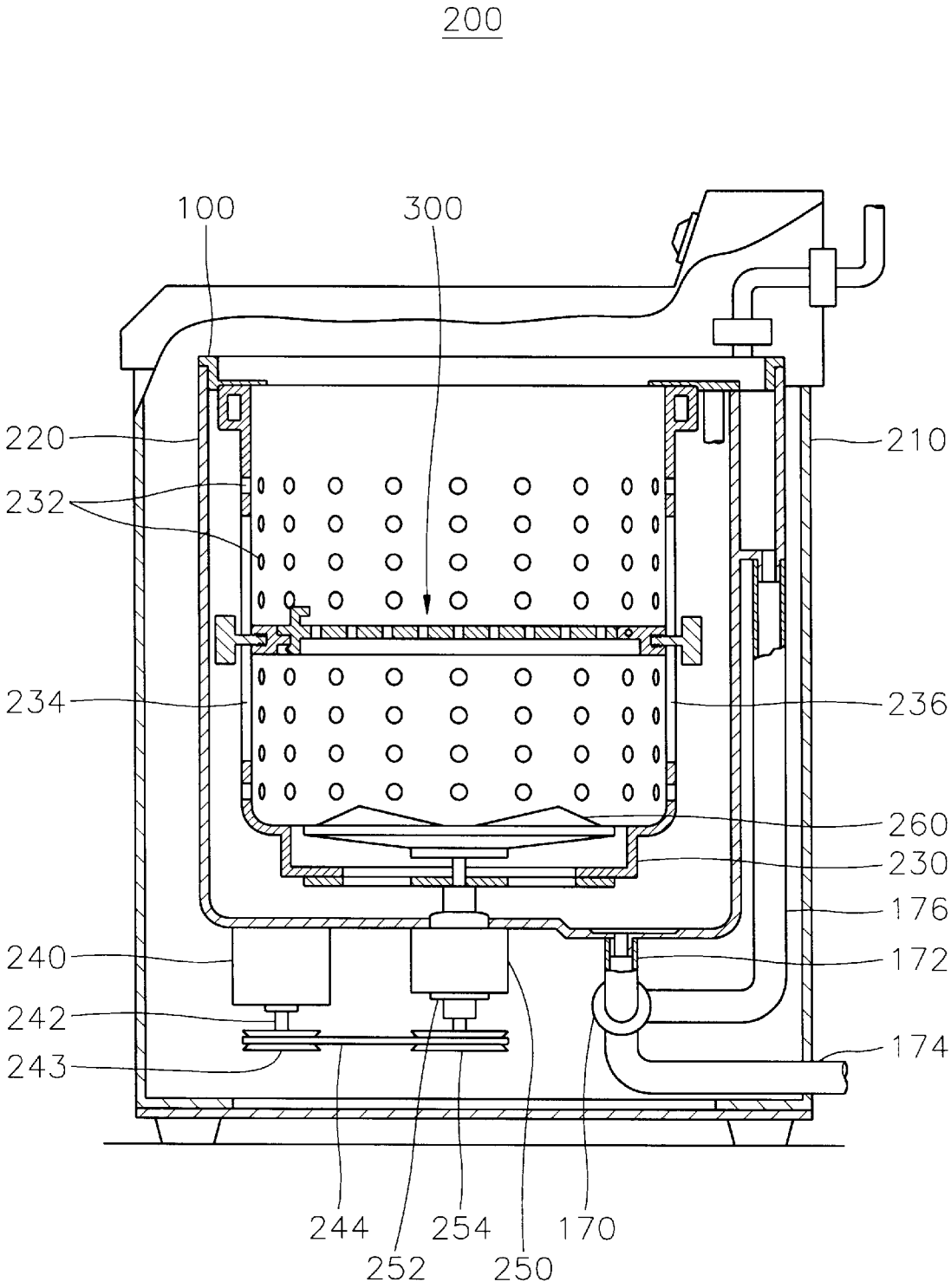
FIG. 1 is a sectional view showing the structure of a washing machine according to one embodiment of the present invention.

FIG. 1 shows a washing machine 200 according to one embodiment of the present invention.

As shown in FIG. 1, washing machine 200 of the present invention includes a housing 210. An outer tub 220 for receiving a washing liquid is disposed in housing 210. Enclosed within outer tub 220 is a spin tub 230 formed at its side wall with a plurality of discharging holes 232. In addition, first and second elongated slots 234 and 236 are provided in the side wall of spin tub 230. First and second elongated slots 234 and 236 are longitudinally formed in opposition to each other.

According to a preferred embodiment of the present invention, first and second elongated slots 234 and 236 extend along the whole length of spin tub 230. Though first and second elongated slots 234 and 236 are illustrated as rectangular shapes in FIG. 1, their shapes can vary according to embodiments of the present invention.

A spin tub cover assembly 300 is installed in spin tub 230 in such a manner that spin tub cover assembly 300 can move up and down along first and second elongated slots 234 and 236. Spin tub cover assembly 300 will be more detailedly described below with reference to FIG. 2.

Disposed below outer tub 220 are a motor 240 generating a rotational force for operating washing machine 200, and a gear assembly 250 which receives the rotational force from motor 240, and then transmits the rotational force to spin tub 230 or to a pulsator 260 rotatably mounted on a bottom wall of spin tub 230. According to a preferred embodiment of the present invention, motor 240 includes a reversible motor.

A spraying nozzle assembly 100 is mounted on an upper portion of outer tub 220 so as to spray the washing liquid onto the articles. A circulation pump 170 is disposed at a lower portion of housing 210. Circulation pump 170 is communicated with outer tub 220 so as to circulate the washing liquid into spraying nozzle assembly 100 or so as to drain the washing liquid out of washing machine 200 through a drain tube 174.

Motor 240 has a motor shaft 242 which is formed at its lower end with a first pulley 243. Gear assembly 250 has a rotating shaft 252 which is formed at its lower end with a second pulley 254. Second pulley 254 is connected to first pulley 243 by a belt 244 in such a manner that the rotational force of motor 240 can be transmitted to gear assembly 250.

In addition, circulation pump 170 has a pump motor (not shown) therein and is connected to outer tub 220 through a discharging tube 172 so as to receive the washing liquid from outer tub 220. Circulation pump 170 is also connected to spraying nozzle assembly 100 through a circulation tube 176, so that the circulated washing liquid is sprayed into spin tub 230.

Figure 2:
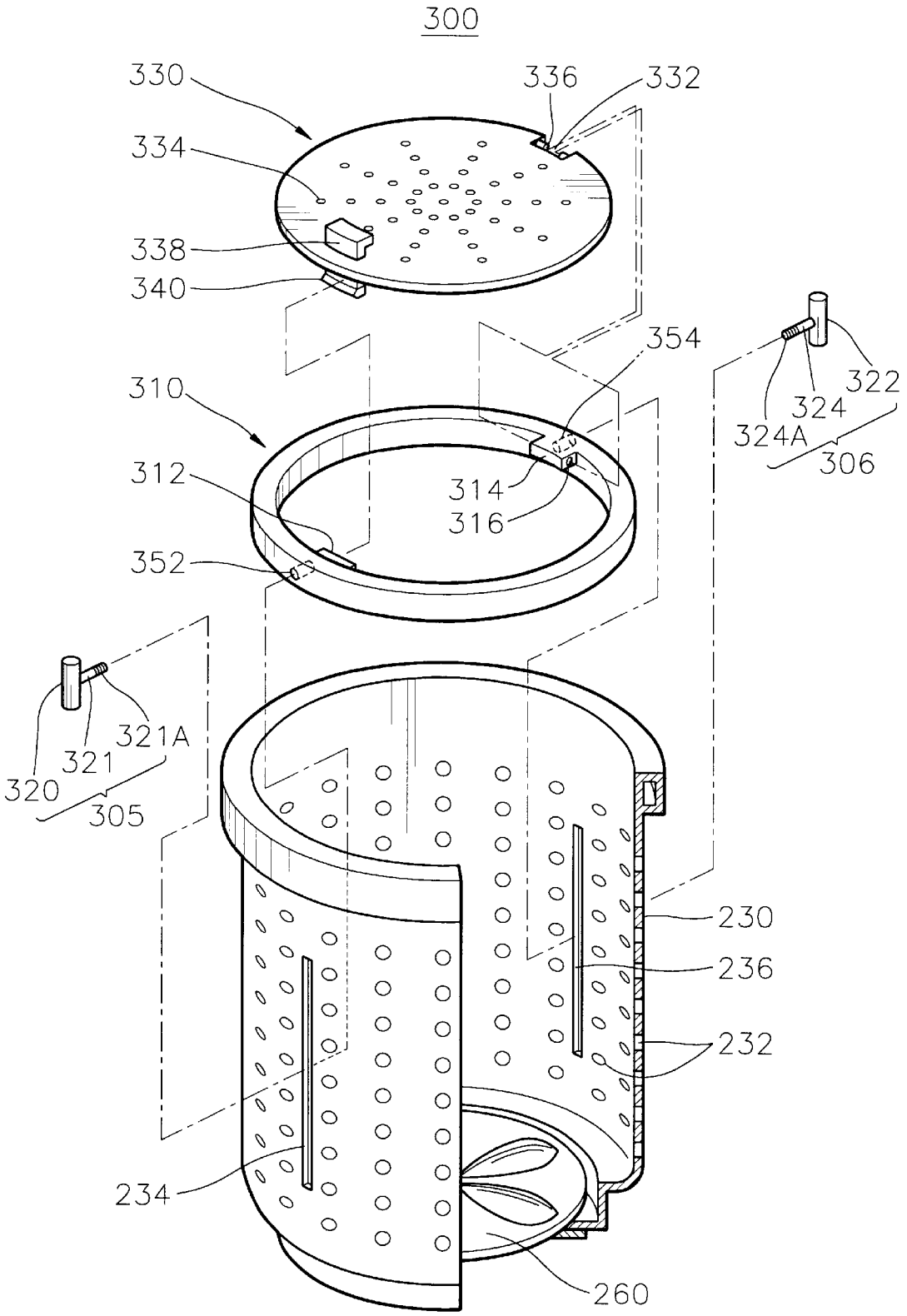
FIG. 2 is an exploded perspective view of a spin tub cover assembly shown in FIG. 1.
Figure 3:
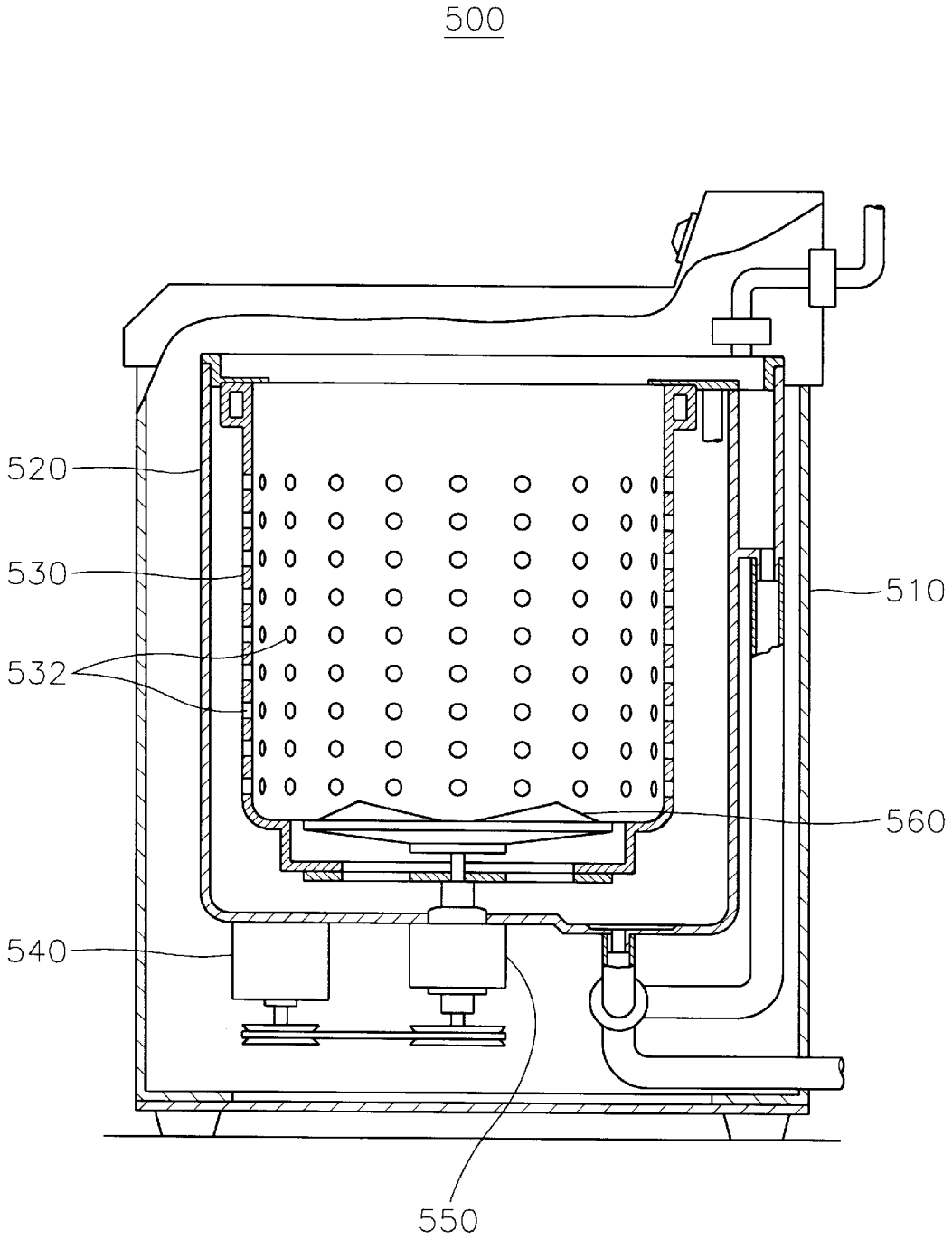
FIG. 3 (PRIOR ART)
FIG. 3 is a sectional view showing the structure of a conventional washing machine.

Referring to FIG. 2, spin tub cover assembly 300 includes an annular frame 310 movably disposed in spin tub 230, includes first and second coupling pins 305 and 306 by which annular frame 310 is movably attached to spin tub 230, and includes a cover plate 330 hinged to annular frame 310.

According to a preferred embodiment of the present invention, both annular frame 310 and cover plate 330 have specific gravities lower than the specific gravity of water, so they float on the surface of the washing liquid when the washing liquid is supplied into outer tub 220.

Annular frame 310 has an outer diameter substantially identical to an inner diameter of spin tub 230, and is formed at an inner wall thereof with a protrusion 314. Protrusion 314 has a perforation hole 316 therein and extends radially inward from the inner wall of annular frame 310. In addition, at a position opposite to protrusion 314 in the inner wall of annular frame 310, there is provided a fixing member 312 which extends radially inward therefrom. Fixing member 312 is manufactured by an elastic material. Fixing member 312 has an engagement groove (not shown). First and second screw holes 352 and 354, which are formed in opposition to each other, are provided in an outer wall of annular frame 310.

First coupling pin 305 includes a first cylindrical head portion 320 and a first shaft 321 provided at its terminal end with a first screw portion 321A. In addition, second coupling pin 306 includes a second cylindrical head portion 322 and a second shaft 324 provided at its terminal end with a second screw portion 324A. First and second screw portions 321A and 324A are respectively screw-coupled into first and second screw holes 352 and 354 of annular frame 310 through first and second elongated slots 234 and 236 of spin tub 230. Diameters of first and second shaft 321 and 324 are smaller than widths of first and second elongated slots 234 and 236, so that annular frame 310 attached to spin tub 230 can move up and down along first and second elongated slots 234 and 236.

In order to permit access into spin tub 230, cover plate 330 is pivotably mounted on annular frame 310. Cover plate 330 has an outer diameter substantially identical to an inner diameter of annular frame 310, and is formed at a circumference thereof with a recess 332 which is engaged with protrusion 314 of annular frame 310. At both side walls of recess 332, there are provided a pair of hinge pins 336 which are inserted into perforation hole 316 of protrusion 314.

In addition, a latch 340, which is detachably engaged with the engagement groove of fixing member 312, is provided on an under surface of cover plate 330 in opposition to the position of recess 332. Latch 340 is integrally formed on the under surface of cover plate 330 and extends downwards therefrom by a predetermined length. Latch 340 is manufactured with an elastic material. While the washing cycle is being carried out, latch 340 is fixedly engaged with the engagement groove of fixing member 312, so noise caused by the vibration of cover plate 330 can be reduced. At an upper surface of cover plate 330, just above latch 340, a knob 338 for facilitating opening and closing of cover plate 330 is integrally formed.

When it is required to secure cover plate 330 to annular frame 310, a user pushes knob 338 downwards. As a result, since latch 340 and fixing member 312 are made by elastic materials, latch 340 makes slide-contact with fixing member 312 and is engaged with the engagement groove of fixing member 312. In this state, when it is required to release cover plate 330 from annular frame 310, the user lifts knob 338 upwards. As a result, latch 340 moves upwards while pushing fixing member 312 of annular frame 310, so cover plate 330 can be released from annular frame 310.

In addition, cover plate 330 is formed with a plurality of apertures 334. While the washing cycle is being carried out, some of the washing liquid agitated by pulsator 260 can pass through apertures 334, so the washing liquid does not strongly impact on cover plate 330. Therefore, cover plate 330 can be stably secured to annular frame 310.

A washing machine 200 having the construction as described above operates as follows.

First, when it is required to wash the articles, a user puts the articles into spin tub 230 and fixes cover plate 330 to annular frame 310.

In this state, if the user pushes an operating button installed on a control panel, the washing liquid is introduced from a liquid source into outer tub 220 until a liquid level in outer tub 220 reaches a predetermined level. At this time, since both annular frame 310 and cover plate 330 have specific gravities lower than the specific gravity of water, spin tub cover assembly 300 floating on the surface of the washing liquid moves upwards along first and second elongated slots 234 and 236 as the liquid level in outer tub 220 rises. Accordingly, the articles in spin tub 230 are completely immersed in the washing liquid without being exposed above the surface of the washing liquid.

Then, when the liquid level in outer tub 220 reaches the predetermined liquid level, a liquid feed control valve blocks a liquid feeding pipe, so the washing liquid stops being supplied into outer tub 220. At the same time, motor 240 rotates in the forward and reverse directions. The rotational force of motor 240 is transmitted to pulsator 260 by way of motor shaft 242, first pulley 243, belt 244, second pulley 254, and gear assembly 250. As a result, pulsator 260 rotates in the forward and reverse directions, thereby generating the swirl-shaped liquid flows in spin tub 230.

Since the articles in spin tub 230 are completely immersed in the washing liquid, the articles can widely collide with the swirl-shaped liquid flows, so the washing effect is improved.

In addition, while the washing cycle is being carried out, circulation pump 170 operates according to a predetermined algorithm, so some of the washing liquid that has been introduced into outer tub 220 is discharged from outer tub 220 into circulation pump 170 through discharging tube 172. Upon receiving the washing liquid, circulation pump 170 compresses the washing liquid and circulates the washing liquid through circulation tube 176 into spraying nozzle assembly 100 mounted on the upper portion of outer tub 220. Spraying nozzle assembly 100 strongly sprays the circulated washing liquid onto the articles in spin tub 230, thereby further improving the washing effect.

When the washing cycle has finished, the pump motor rotates in the reverse direction. At this time, a first valve disposed between circulation pump 170 and circulation tube 176 is closed, and a second valve disposed between circulation pump 170 and drain tube 174 is opened. Accordingly, the washing liquid filled in outer tub 220 is drained out of washing machine 200 by way of discharging tube 172, circulation pump 170, and drain tube 174.

While the washing liquid is being drained out of washing machine 200, spin tub cover assembly 300 floating on the surface of the washing liquid moves downwards along first and second elongated slots 234 and 236. When the washing liquid has been completely drained out of washing machine 200, spin tub cover assembly 300 is seated on the articles.

Then, the dehydrating cycle begins. While the dehydrating cycle is being carried out, spin tub 230 rotates at a high speed so that the articles are forced towards the side wall of spin tub 230 due to a centrifugal force. As a result, the washing liquid contained in the articles is discharged through discharging holes 232 of spin tub 230, and is drained out of washing machine 200.

As described above, the washing machine of the present invention can immerse the articles into the washing liquid by means of the spin tub cover assembly, so the articles widely collide with the liquid flows within the spin tub, thereby improving the washing effect.

Furthermore, since the spin tub cover assembly is disposed above the articles, the articles are prevented from flying out of the spin tub during the dehydrating cycle.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A washing machine comprising:

a housing, an outer tub for receiving a washing liquid, the outer tub being disposed in the housing;

a spin tub formed at a side wall thereof with a plurality of discharging holes, the spin tub being disposed in the outer tub;

a pulsator rotatably mounted on a bottom wall of the spin tub;

a first means for immersing an article to be washed into the washing liquid, the first means including an annular frame movably disposed in the spin tub;

a second means for movably coupling the annular frame to the spin tub; and a cover plate hinged to the annular frame, the annular frame being movable up and down along a length of the spin tub.

2. The washing machine as claimed in claim 1, wherein the annular frame and the cover plate are manufactured with a material having a specific gravity lower than the specific gravity of the washing liquid so that the annular frame and the cover plate float on a surface of the washing liquid.

3. The washing machine as claimed in claim 1, wherein the annular frame is provided at an inner wall thereof with a protrusion extending radially inward from the inner wall of the annular frame, and the cover plate is formed at a first predetermined position of a circumference thereof with a recess engaging the protrusion of the annular frame.

4. The washing machine as claimed in claim 3, wherein the protrusion has a perforation hole, and the recess is provided at both side walls thereof with first and second hinge pins, which are inserted into the perforation hole of the protrusion.

5. The washing machine as claimed in claim 3, wherein the cover plate is integrally provided at a second predetermined position of an under surface thereof with a latch, and the annular frame is provided at a third predetermined position of the inner wall thereof with a fixing member for detachably securing the latch, the latch being positioned opposite to the recess and extending downwardly from the under surface of the cover plate, the fixing member being positioned opposite to the protrusion.

6. The washing machine as claimed in claim 5, wherein the fixing member has an engagement groove into which the latch is detachably engageable, and the fixing member is integrally formed with the inner wall of the annular frame.

7. The washing machine as claimed in claim 5, wherein the cover plate is integrally provided at an upper surface thereof with a knob for opening and closing the cover plate, the knob being positioned just above the latch.

8. The washing machine as claimed in claim 5, wherein the latch and the fixing member are manufactured with an elastic material.

9. The washing machine as claimed in claim 1, wherein the cover plate is formed with a plurality of apertures.

10. The washing machine as claimed in claim 1, wherein the second means includes first and second elongated slots longitudinally formed in the side wall of the spin tub in opposition to each other, first and second screw holes formed in an outer wall of the annular frame in opposition to each other, and first and second coupling pins respectively screw-coupled into the first and second screw holes through the first and second elongated slots.

11. The washing machine as claimed in claim 10, wherein the first and second elongated slots extend along a whole length of the spin tub.

12. The washing machine as claimed in claim 10, wherein the first coupling pin includes a first cylindrical head portion, a first shaft coupled to the first cylindrical head, and a first screw portion integrally formed at a terminal end of the first shaft, the second coupling includes a second cylindrical head portion, a second shaft coupled to the second cylindrical head, and a second screw portion integrally formed at a terminal end of the second shaft, the first and second screw portions being screw-coupled into the first and second screw holes, respectively.

13. The washing machine as claimed in claim 12, wherein the first and second shafts have diameters smaller than widths of the first and second elongated slots.

14. A washing machine comprising:

a housing;

an outer tub for receiving a washing liquid, the outer tub being disposed in the housing;

a spin tub formed at a side wall thereof with first and second elongated slots, the spin tub being disposed in the outer tub, the first and second elongated slots being longitudinally formed along a whole length of the spin tub;

a pulsator rotatably mounted on a bottom wall of the spin tub; and a spin tub cover assembly for immersing an article to be washed into the washing liquid, wherein the spin tub cover assembly includes an annular frame movably disposed in the spin tub, first and second coupling pins for movably coupling the annular frame to the spin tub, and a cover plate hinged to the annular frame, the spin tub cover assembly is movable up and down along the first and second elongated slots, the annular frame and the cover plate are manufactured by a material having a specific gravity lower than the specific gravity of the washing liquid, the annular frame is provided at an inner wall thereof with a protrusion extending radially inward from the inner wall of the annular frame, the cover plate is formed at a first predetermined position of a circumference thereof with a recess which is engaged with the protrusion of the annular frame, the protrusion has a perforation hole, the recess is provided at both side wall thereof with first and second hinge pins, which are inserted into the perforation hole of the protrusion, the cover plate is integrally provided at a second predetermined position of an under surface thereof with an elastic latch, the annular frame is provided at a third predetermined position of the inner wall thereof with an elastic fixing member for detachably securing the latch, the latch is oppositely positioned to the recess and extending downwards from the under surface of the cover plate, the fixing member is oppositely positioned to the protrusion, the fixing member has an engagement groove into which the latch is detachably engageable, the cover plate is integrally provided at an upper surface thereof with a knob for opening and closing the cover plate, the knob is positioned just above the latch, the cover plate is formed with a plurality of apertures, the annular frame is formed at an outer wall thereof with first and second screw holes, the first and second coupling pins are respectively screw-coupled into the first and second screw holes through the first and second elongated slots, the first coupling pin includes a first cylindrical head portion, a first shaft coupled to the first cylindrical head, and a first screw portion integrally formed at a terminal end of the first shaft, the second coupling includes a second cylindrical head portion, a second shaft coupled to the second cylindrical head, and a second screw portion integrally formed at a terminal end of the second shaft, the first and second screw portions are respectively screw-coupled into the first and second screw holes, and the first and second shafts have diameters smaller than widths of the first and second elongated slots.

* * * * *